US012359566B2

(12) United States Patent
Wehrmeyer et al.

(10) Patent No.: US 12,359,566 B2
(45) Date of Patent: Jul. 15, 2025

(54) DEVICE AND METHOD FOR DRIVING A TUNNEL

(71) Applicant: HERRENKNECHT AKTIENGESELLSCHAFT, Schwanau (DE)

(72) Inventors: Gerhard Wehrmeyer, Schwanau (DE); Linus Möller, Schwanau (DE); Werner Burger, Schwanau (DE); Andreas Kassel, Schwanau (DE)

(73) Assignee: HERRENKNECHT AKTIENGESELLSCHAFT, Schwanau (DE)

( * ) Notice: Subject to any disclaimer, the term of this patent is extended or adjusted under 35 U.S.C. 154(b) by 119 days.

(21) Appl. No.: 18/020,114

(22) PCT Filed: Dec. 3, 2021

(86) PCT No.: PCT/EP2021/084156
§ 371 (c)(1),
(2) Date: Feb. 7, 2023

(87) PCT Pub. No.: WO2022/128532
PCT Pub. Date: Jun. 23, 2022

(65) Prior Publication Data

US 2023/0258084 A1 Aug. 17, 2023

(30) Foreign Application Priority Data

Dec. 14, 2020 (DE) ..... 102020133386.2

(51) Int. Cl.
*E21D 9/00* (2006.01)
*E21D 9/11* (2006.01)

(52) U.S. Cl.
CPC ..... *E21D 9/003* (2013.01); *E21D 9/112* (2013.01)

(58) Field of Classification Search
CPC ..... E21D 9/003; E21D 9/112; E21B 47/00; E21C 39/00
See application file for complete search history.

(56) References Cited

U.S. PATENT DOCUMENTS 5,106,163 A 4/1992 Fujiwara et al.
5,240,350 A 8/1993 Yamaguchi et al.
(Continued)

FOREIGN PATENT DOCUMENTS

CN 106194202 A 12/2016
CN 110187401 A 8/2019
(Continued)

OTHER PUBLICATIONS

Kneib et al. "Automatic seismic prediction ahead of the tunnel boring machine" 1. 2. 4. 7. 11 Jul. 31, 2000 (Jul. 31, 2000). pp. 1-8. Retrieved from the Internet: https://onlinelibrary.wiley.com/doi/epdf/10.1046/j.1365-2397.2000.00079.x [retrieved on Mar. 16, 2022] XP055902151 figures 1-4 the whole document.
(Continued)

*Primary Examiner* — Carib A Oquendo
(74) *Attorney, Agent, or Firm* — Tarolli, Sundheim, Covell & Tummino LLP

(57) ABSTRACT

An apparatus for excavating a tunnel includes a cutting wheel equipped with measuring modules of sensor means on its cutting wheel face in order to directly sample the consistency of the material present between the cutting wheel face and a tunnel face by recording different types of measured values characteristic of this.

20 Claims, 8 Drawing Sheets

(56) References Cited

U.S. PATENT DOCUMENTS

| | | | | |
|---|---|---|---|---|
| 2009/0297273 | A1* | 12/2009 | Lindbergh | G01P 3/22 702/9 |
| 2018/0258765 | A1* | 9/2018 | Okada | E21D 9/11 |
| 2019/0017380 | A1* | 1/2019 | Wang | E21D 9/1066 |
| 2019/0112924 | A1 | 4/2019 | Kawai et al. | |
| 2021/0180452 | A1 | 6/2021 | Weiser | |

FOREIGN PATENT DOCUMENTS

| | | | |
|---|---|---|---|
| CN | 212671784 | U | 3/2021 |
| DE | 3819818 | A1 | 12/1989 |
| JP | H0243493 | A | 2/1990 |
| JP | 2004027702 | A | 1/2004 |
| JP | 2010013895 | | 1/2010 |
| JP | 2015021340 | A | 2/2015 |
| JP | 2015212476 | A | 11/2015 |
| JP | 2016003430 | A | 1/2016 |
| JP | 2017096049 | A | 6/2017 |
| JP | 2017101436 | A | 6/2017 |
| JP | 2019143383 | A | 8/2019 |

OTHER PUBLICATIONS

Herrenknecht Martin et al. "The development of earth pressure shields: from the beginning to the present / Entwicklung der Erddruckschilde: Von den Anfangen bis zur Gegenwart" Geomechanik Und Tunnelbau: Geomechanics and Tunnelling, DE, vol. 4, No. 1, Feb. 1, 2011 (Feb. 1, 2011), pp. 11-35 DOI: 10.1002/geot.201100003 ISSN: 1865-7362, XP055902975 the soil material in the mining chamber is optically monitored by means of a camera [28]; p. 24, col. 2, paragraph 3; figure 2.

* cited by examiner

DEVICE AND METHOD FOR DRIVING A TUNNEL

RELATED APPLICATIONS

This application claims the benefit of International Application No. PCT/EP2021/084156, filed Dec. 3, 2021, and German Patent Appln. No. 102020133386.2, filed Dec. 14, 2020 the entirety of which are incorporated by reference herein.

TECHNICAL FIELD

The invention relates to an apparatus for excavating a tunnel according to the preamble of claim 1.

The invention further relates to a method for excavating a tunnel.

BACKGROUND

Such an apparatus is known from U.S. Pat. No. 5,106,163 A. The previously known apparatus has a rotatable cutting wheel, with which existing geology can be excavated in an excavation direction at the front on a tunnel face with excavation tools arranged on a cutting wheel face. Material excavated from the tunnel face can be conveyed into an excavation chamber arranged on the back of the cutting wheel face. Furthermore, there is a discharge unit, with which material present in the excavation chamber can be removed. Furthermore, sensor means are provided which are arranged on the cutting wheel face and which are configured for optically examining the state of excavation tools or the surrounding area thereof in the excavation direction in front of the cutting wheel face. A tunnel can be excavated with the previously known apparatus.

JP 2015 212476 A discloses a method for recording the properties of excavated material in an excavated chamber and an apparatus for testing the plastic fluidity of earth and sand in a tunnel boring machine, in which additives introduced into a chamber located on the back of a cutting wheel by means of mixing elements, which are moveable in opposite directions, are miscible with the excavated material, and the resulting mixture can be tested for certain fluidity properties.

A tunnel boring machine which is configured to optically monitor excavated soil material in an excavation chamber with a camera is known from the article HERRENKNECHT MARTIN ET AL: "The development of earth pressure shields: from the beginning to the present/Entwicklung der Erddruckschilde: Von den Anfangen bis zur Gegenwart," GEOMECHANIK UND TUNNELBAU: GEOMECHANICS AND TUNNELING, Vol. 4, No. 1, 1 Feb. 2011 (2011 Feb. 1), pages 11-35, XP055902975, DE ISSN: 1865-7362, DOI: 10.1002/geot.201100003.

DE 10 2018 113 788 A1 discloses a tunnel boring machine with a cutting wheel fitted with excavation tools, which tunnel boring machine is configured to record certain operating parameters of excavation tools and to use them for planning the excavation.

DE 38 19 818 A1 discloses a tunnel boring machine which is configured for advance exploration of the region in front of the tunnel face in the excavation direction.

A tunnel boring machine which is configured for an automated seismic prediction for advance exploration of the region in front of a tunnel face in the excavation direction is known from Kneib ET AL: "Automatic seismic prediction ahead of the tunnel boring machine," 31 Jul. 2000 (2000 Jul. 31), pages 1-8, XP055902151, found on the Internet at: URL: https://onlinelibrary.wiley.com/doi/epdf/10.1046/j.1365-2397.2000.00079.x [retrieved on 2022 Mar. 16].

A tunnel boring machine which is aligned with acceleration sensors in order to obtain measured values for a distribution of soil at predetermined angles of rotation is known from JP 2016 003 430 A.

JP 2004 027702 A discloses a tunnel boring machine which is configured to obtain information about the soil in the region in of the cutting wheel face by means of sound sensors arranged on the cutting wheel face.

CN 110 187 401 A discloses a tunnel boring machine which is configured to obtain information about the tunnel face by means of a three-dimensional image acquisition device.

JP H02 43493 A discloses a tunnel boring machine in which pressure sensors can be used to detect the state of excavated material introduced into an excavated chamber arranged on the back of a cutting wheel via the discharge path in order to ensure reliable removal of the excavated material.

A tunnel boring machine is known from EP 3 428 388 A1 which is configured for monitoring the state of wear of excavation tools attached to a cutting wheel.

JP 2010-13895 A discloses an apparatus which has a rotatable cutting wheel, with which the existing geology can be excavated in an excavation direction at the front on a tunnel face with excavation tools arranged on a cutting wheel face. Material excavated from the tunnel face can be conveyed into an excavation chamber arranged on the back of the cutting wheel face. Furthermore, there is a discharge unit, with which material present in the excavation chamber can be removed. Furthermore, sensor means are provided which interact with the material present in the excavation chamber in order to record measured values characteristic of the consistency of material excavated at the tunnel face. A tunnel can be excavated with the previously known apparatus.

DE 691 22 010 T2 discloses a position determination system for an excavator which has conductor loops and at least one magnetic field detector which can be moved relative to one another in order to use a position calculator to calculate the position of the excavator relative to a reference position.

DE 20 2019 100 821 U1 discloses an apparatus for examining the adhesion of sample material to predict excavating conditions in tunnel excavation, which apparatus is integrated into a test stand and has a rotatable cutting wheel arranged in a material-receiving tube. The cutting wheel is intended to come into contact with the sample material placed in the material-receiving tube and is equipped with sensors for this purpose, which are configured to measure at least one measured variable. The measured variables include deformation of the cutting wheel, torque of the cutting wheel, electrical conductivity of the cutting wheel, wear on the cutting wheel, and pressure on the cutting wheel.

SUMMARY OF THE INVENTION

The invention is based on the object of specifying an apparatus of the type mentioned at the beginning, with which the consistency of the material present between the cutting wheel face and the tunnel face can be reliably determined, in particular for the relatively reliable avoidance of unwanted adhesions and excessive wear and for the reliable support of the tunnel face.

This object is achieved with an apparatus of the aforementioned type according to the invention with the characterizing features of claim 1.

This object is achieved with a method for excavating a tunnel according to the invention having the features of claim 7.

Due to the fact that, according to the invention, measuring modules of the sensor means are arranged on the cutting wheel face and the measuring modules arranged there are configured to record different types of measured values that are characteristic of the consistency of material excavated at the tunnel face, the consistency of the material present between the cutting wheel face and the tunnel face can be determined very directly and relatively precisely by linking the measured values of different types, so that the consistency of this material can be influenced directly with conditioning means, for example via a control circuit unit. This prevents unwanted adhesions and excessive wear of excavation tools and reliably supports the tunnel face.

Further expedient embodiments of the invention are the subject matter of the dependent claims.

Further expedient embodiments and advantages of the invention result from the following description of an exemplary embodiment of the invention with reference to the figures of the drawing.

DETAILED DESCRIPTION

Figure 1:
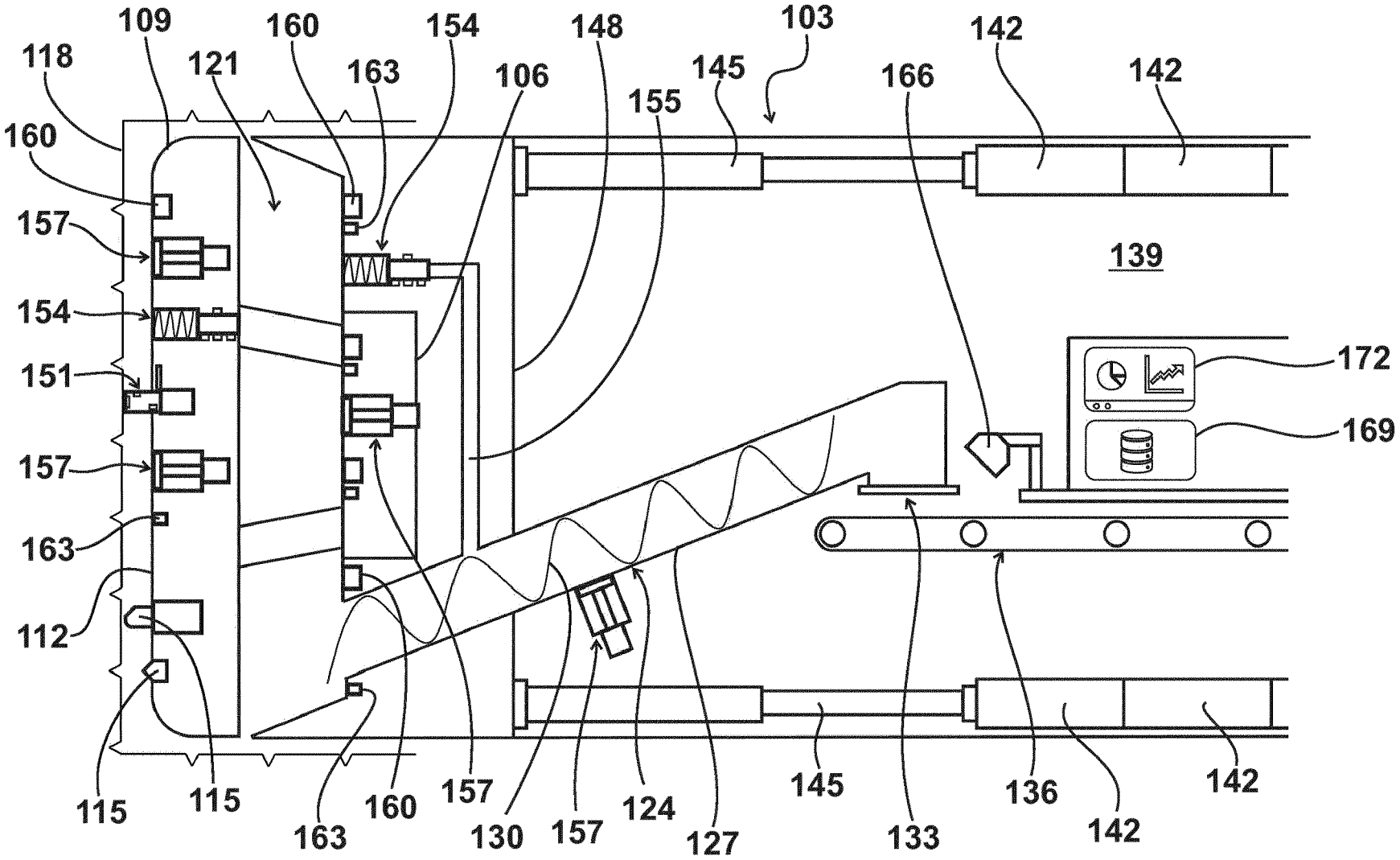
FIG. 1 shows a schematic side view of an apparatus for excavating a tunnel in the form of a tunnel boring machine configured for earth-pressure-balanced excavating.

FIG. 1 shows a schematic, simplified side view of an exemplary embodiment of an apparatus for excavating a tunnel according to the invention in the form of a tunnel boring machine 103 configured for earth-pressure-balanced (EPB) tunneling. The tunnel boring machine 103 has a cutting wheel 109 which can be rotated via a cutting wheel drive unit 106, with a number of excavation tools 115 being arranged on the cutting wheel face 112. The excavation tools 115 can be used to excavate material on a tunnel face 118 in front of the cutting wheel 109 in the excavation direction. Material excavated on the tunnel face 118 can be conveyed into an excavation chamber 121 arranged on the back of the cutting wheel face 112. The excavated material can be moved from the excavation chamber 121 to a discharge opening 133 via a discharge unit with a screw conveyor unit 124 which has a helical screw 130 which can be rotated in a cladding tube 127.

One end of a discharge belt 136 of the discharge unit is arranged at the discharge opening 133, with which discharge belt the discharged material can be removed through a tunnel space 139.

The tunnel space 139 is lined with segments 142 on the back of the cutting wheel 109, wherein excavation presses 145 abut against on the end faces, facing the cutting wheel 109, of the segments 142 that were last installed, with which excavation presses a machine frame 148 supporting the cutting wheel drive unit 106 and thus the cutting wheel 109 can be pressed against the tunnel face 118.

In addition to the excavation tools 115, the tunnel boring machine 103 shown in FIG. 1 is equipped with at least two measuring modules of sensor means on the cutting wheel face 112 for recording different types of measured values, which measuring modules, in one exemplary embodiment, in at least one paired combination, comprise at least one multi-measuring module 151, at least one spindle measuring module 154, at least one ram measuring module 157, at least one earth pressure measuring module 160, or at least one temperature measuring module 163. As explained in more detail below, the measuring modules 151, 154, 157, 160, 163 of the sensor means are configured to record measured values when the cutting wheel 109 is stationary or when the cutting wheel 109 is rotating, from which measured values characteristic measured variables can be set, overall for the consistency of the material present between the cutting wheel face 112 and at the tunnel face 118, for a control circuit unit for the controlled, largely automated conditioning of the material present between the cutting wheel face 112 and the tunnel face 118 via conditioning elements, which are not shown in FIG. 1.

At least some ram measuring modules 157 are expediently dimensioned in such a way that they can be installed at positions of excavation tools 115 if required.

The or each soil pressure measuring module 160 can be used to determine the soil pressure acting on the cutting wheel face 112, which is related to the consistency of the material present. For example, when there is a possibility of relieving the pressure, such as by allowing more flowable material to flow away, lower pressures and more pasty material exert higher pressures on the earth pressure measuring module 160, which is reflected in the measured values output by the earth pressure measuring module 160.

The temperature measuring module 163 in turn can be used to determine the temperature of the material present between the cutting wheel face 112 and the tunnel face 118 in the vicinity of the temperature measuring module 163, wherein the temperature is related to the consistency of the material. Typically, a relatively high temperature is characteristic of high friction and thus of a relatively viscous to pasty consistency of the material, and a relatively low temperature is characteristic of a more flowable consistency of the material that generates little frictional heat. The measured value output by the temperature measuring module 163 is therefore also characteristic of the consistency of the material.

Provision is advantageously made for conditioning elements arranged in the region between the cutting wheel face 112 and the tunnel face 118 to be configured by adding conditioning elements accordingly to produce at least two zones of different consistencies. Each of these zones can be sampled by at least one measuring module 151, 154, 157, 160, 163 in order to obtain measured values that are characteristic of the respective consistency.

Furthermore, the illustration according to FIG. 1 shows that, on the machine frame 148 on its side adjacent to the excavation chamber 121, further measuring modules of sensor means are arranged, in particular in the form of spindle measuring modules 154, which are each connected to the cladding tube 127 via a bypass line 155, an approximately centrally arranged ram measuring module 157, earth pressure measuring modules 160, and temperature measuring modules 163. Various types of measured values characteristic of the consistency of the material present in the excavation chamber 121 can also be recorded with these sensor means, in order to ensure proper operation of the screw conveyor unit 124, in particular by adding conditioning means to the excavation chamber 121 by means of conditioning elements, which are not shown in FIG. 1. In this case, the consistencies of the material between the cutting wheel face 112 and the tunnel face 118, on the one hand, and, as explained in more detail below, preferably also in zones in the radial direction, and in the excavation chamber 121, on the other hand, are optionally adjustable and, if necessary, also noticeably different, for example in order to obtain a relatively firm consistency for the material discharged onto the discharge belt 136.

The screw conveyor unit 124 is also equipped with at least one sensor means, here in the form of at least one ram measuring module 157, in order to record measured values characteristic of the consistency of the material being discharged.

As a further measuring module of the sensor means, the tunnel boring machine 103 according to FIG. 1 has an image acquisition module 166, which can record images of the material being discharged from the excavation chamber 121 at the discharge opening 133.

The tunnel boring machine 103 is also equipped with an operating data acquisition module 169 and a display module 172. With the operating data acquisition module 169, the different types of measured values recorded by the measuring modules 151, 154, 157, 160, 163 and the images of the image acquisition module 166 can be stored to obtain further measured values based on automated image analysis and processed as input variables for a control circuit unit for optionally separate conditioning of the material between the cutting wheel face 112 and the tunnel face 118 and in the excavation chamber 121. The display module 172 is used to display typical operating parameters for operating personnel so they can intervene manually to condition the material if necessary.

Figure 2:
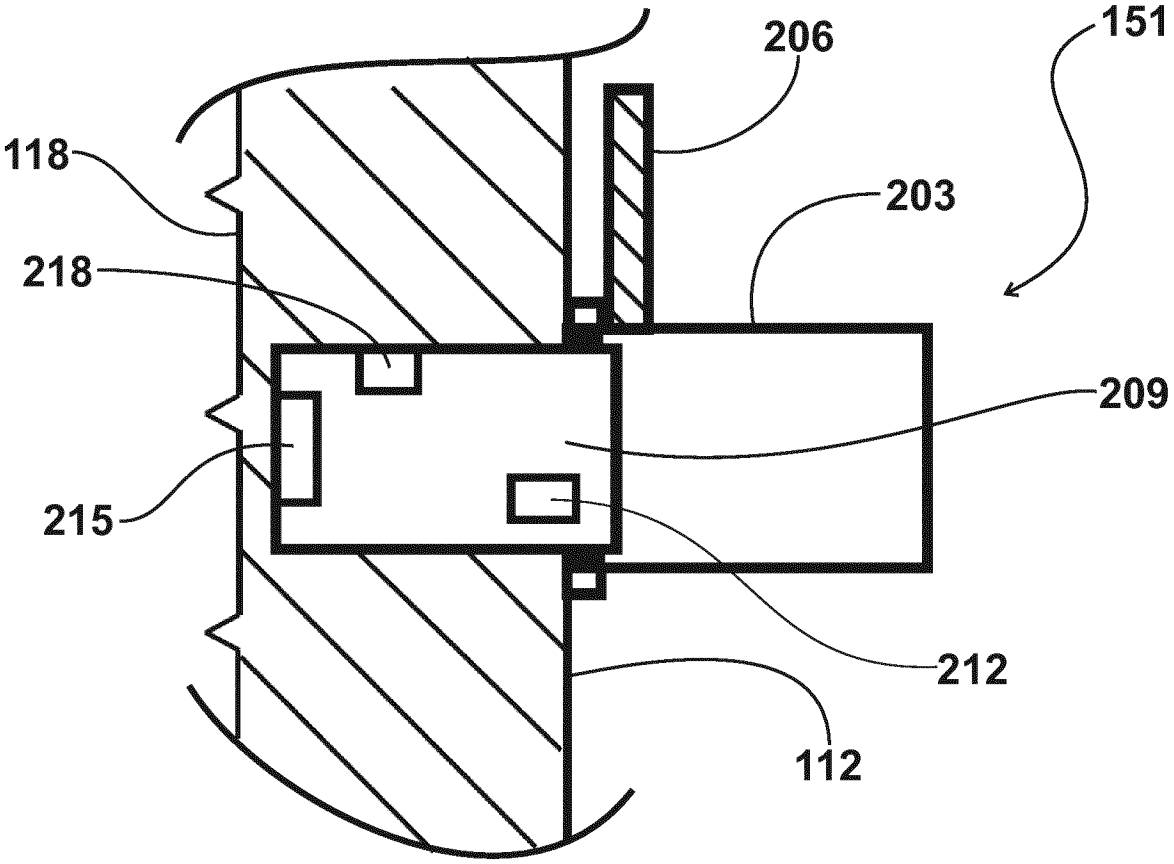
FIG. 2 shows a schematic side view of a multi-measuring module of sensor means.

FIG. 2 shows a schematic side view of a multi-measuring module 151 of the tunnel boring machine 103 explained with reference to FIG. 1. FIG. 2 further shows that the multi-measuring module 151 in this embodiment has a plunger receptacle 203, closed on the back, which can be closed off to the material present between the cutting wheel face 112 and the tunnel face 118 by a closure slide 206 in the region of the cutting wheel face 112. The multi-measuring module 151 is also equipped with a sensor carrier plunger 209 which, when the closure slide 206 is open, can be displaced out of the plunger receptacle 203 via displacement elements, which are not shown in FIG. 2.

The sensor carrier plunger 209 is equipped with at least one bend sensor 212, for example in the form of a strain gauge, with at least one earth pressure sensor 215, facing the tunnel face 118 and arranged on the front, and with at least one temperature sensor 218, with which sensors the deformation of the sensor carrier plunger 209, the pressure exerted on the sensor carrier plunger 209 by the material, or the temperature prevailing in the material in the region of the sensor carrier plunger 209 can be recorded as measured values when the cutting wheel 109 is rotating.

Figure 3:
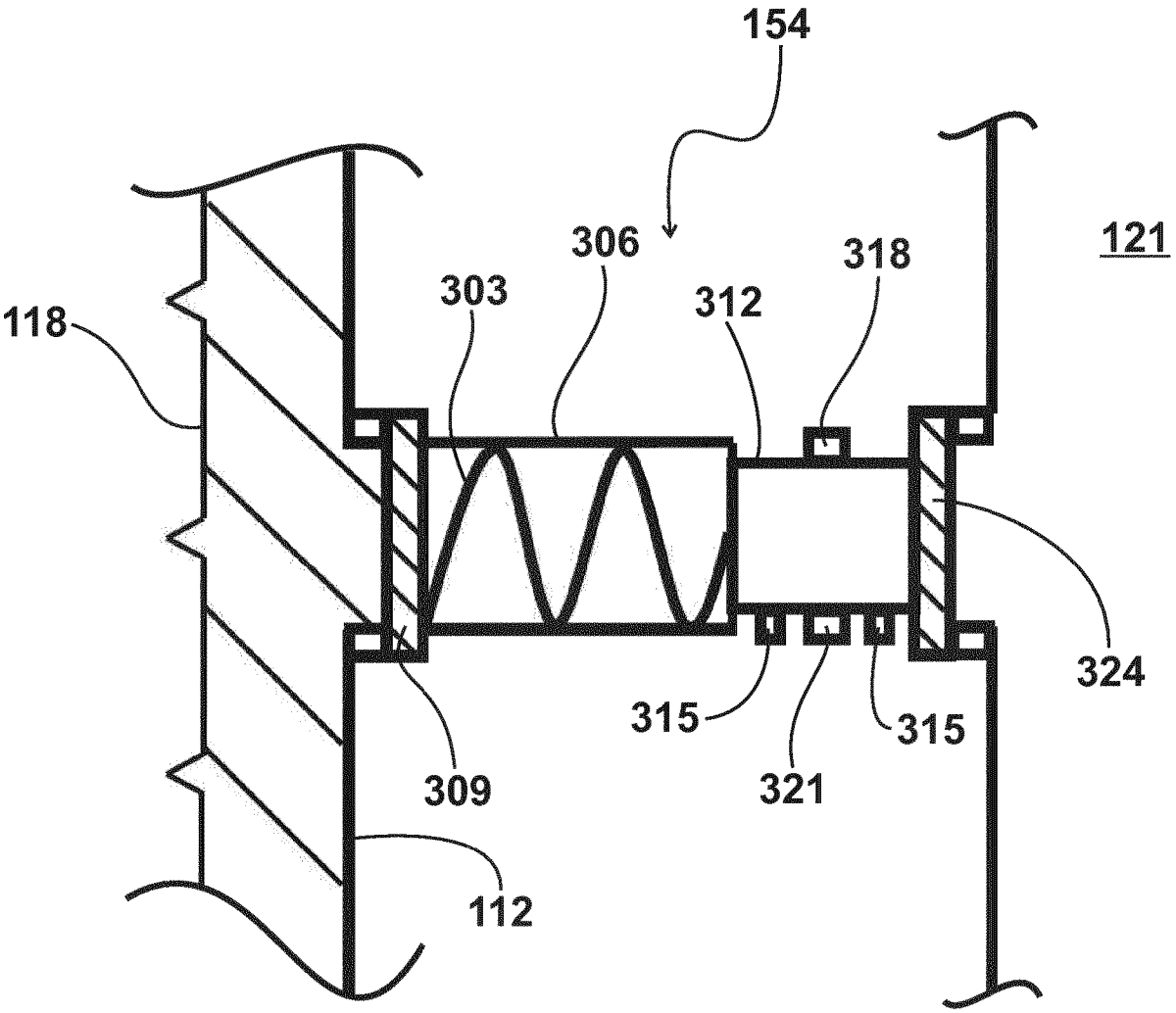
FIG. 3 shows a schematic side view of a spindle measuring module of sensor means.

FIG. 3 shows a schematic side view of a spindle measuring module 154 of the tunnel boring machine 103 explained with reference to FIG. 1. The spindle measuring module 154 has a rotatable sampling screw 303 which is mounted in a guide tube 306 arranged on the back of the cutting wheel face 112 in the excavation direction. The guide tube 306 can be closed off against the material present at the tunnel face 118 on its side facing the cutting wheel face 112 via an inlet slide 309, while a sampling tube 312 is flanged on its side facing away from the cutting wheel face 112, into which sampling tube material present on the cutting wheel face 112 can be conveyed when the sampling tube 303 is rotated after the inlet slide 309 is opened. Moisture sensors 315 and a sound transmission unit with a sound generator 318 and with a sound sensor 321 are attached to the sampling tube 312. With the moisture sensors 315, the moisture can be determined as a measured value and sound transmission parameters can be determined as further measured values which are characteristic of the consistency of the sampled material.

There is an outlet slide 324 on the side of the sampling tube 312 facing away from the guide tube 306; after the outlet slide is opened, the material present in the sampling tube 312 can be discharged into the excavation chamber 121.

Figure 4:
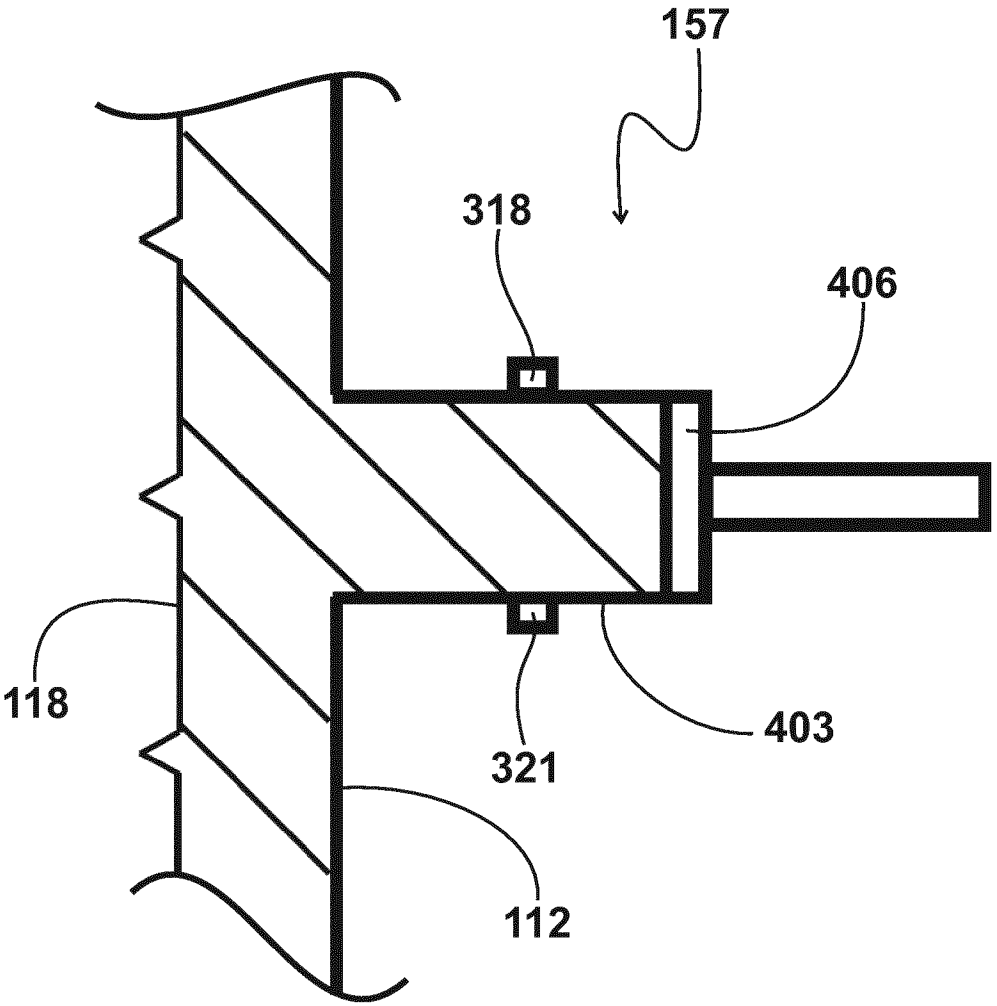
FIG. 4 shows a schematic side view of a ram measuring module of sensor means.

FIG. 4 shows a schematic side view of a ram measuring module 157 of the tunnel boring machine 103 according to FIG. 1. The ram measuring module 157 is equipped with a material receptacle 403 which is open on the cutting wheel face 112 and which is closed at the back by an ejector ram 406 which can be displaced in the longitudinal direction of the material receptacle 403. A sound transmission unit with a sound generator 318 and with a sound sensor 321 is arranged on the material receptacle 403, with which measured values characteristic of the consistency of the material present in the material receptacle 403 can be recorded. In order to eject material present in the material receptacle 403, the ejector ram 406 can expediently be displaced in the direction of the cutting wheel face 112, at least flush thereto, to enable new material to enter the material receptacle 403 after a certain time, after pushback, and then to record measured values characteristic of the consistency thereof upon the next noise transmission.

Furthermore, the ram measuring module 157 is configured to measure distance force values both when extending beyond the cutting wheel face 112 and also when retracting, i.e. to absorb the force required to move along a certain distance during extension and/or during retraction, which values are characteristic of the consistency of the material in question.

Figure 5:
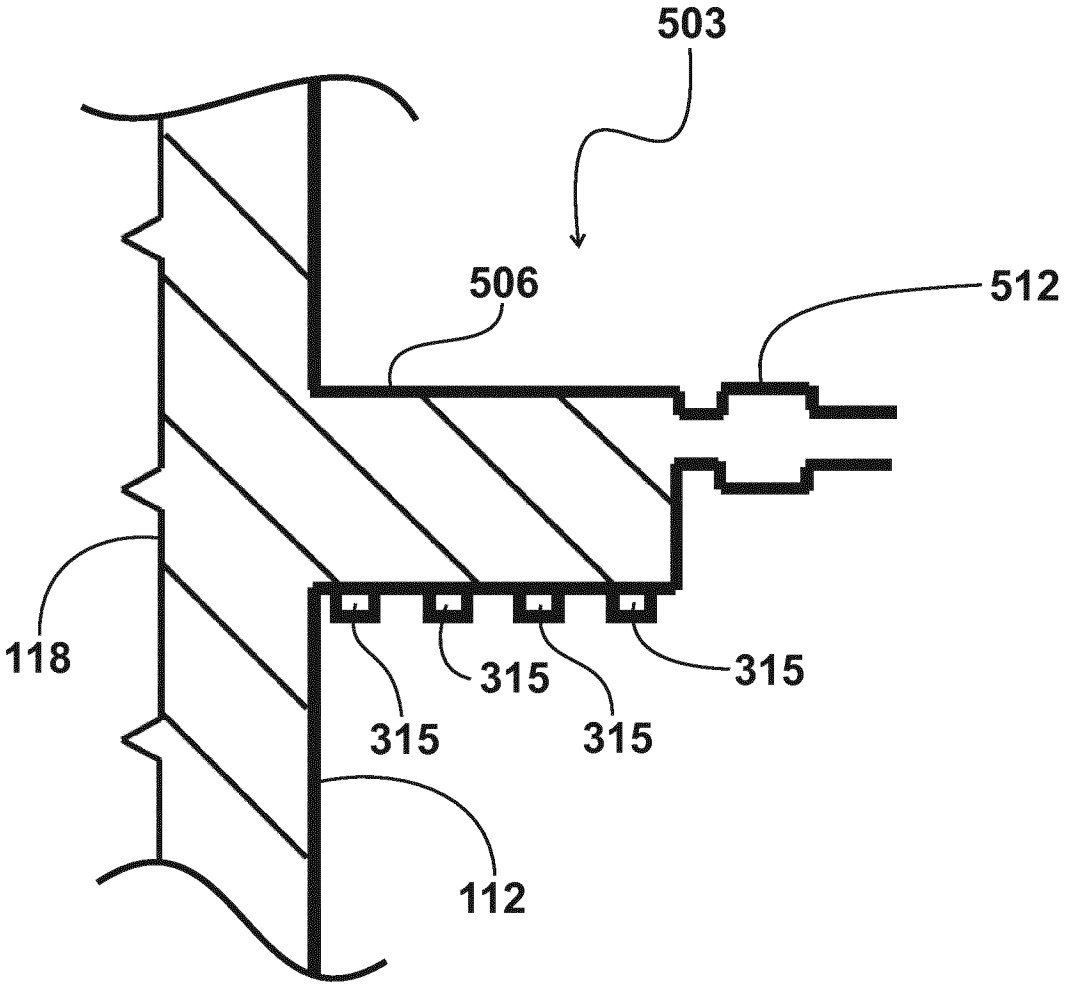
FIG. 5 shows a schematic side view of a moisture measuring module of sensor means.

In a simplified side view, FIG. 5 shows a moisture measuring module 503 as a further measuring module of the sensor means, which module is equipped with a material receptacle 506 open on the cutting wheel face 112. A number of moisture sensors 315 are arranged on the side walls of the material receptacle 506, with which moisture sensors the moisture of the material present in the material receptacle 506 can be determined as measured values. At the end of the material receptacle 506 facing away from the cutting wheel face 112, the moisture measuring module 503 has a flow meter 512, with which a volume flow of liquid pressed out of the material present in the material receptacle 506 due to the prevailing pressure can be recorded as a further measured value characteristic of the consistency of the material.

Figure 6:
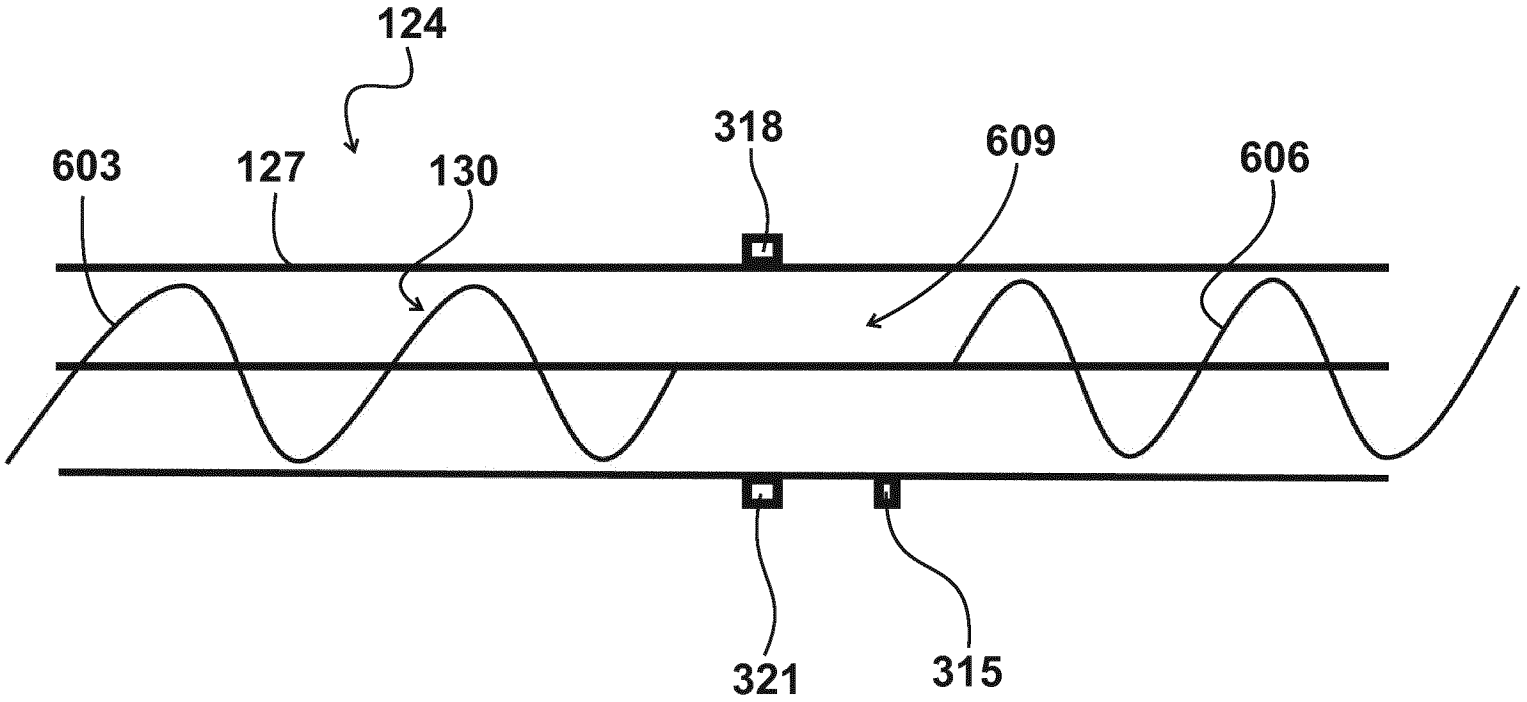
FIG. 6 shows a schematic side view of a refinement of a helical screw of a screw conveyor unit.

FIG. 6 shows a schematic side view of a refinement of a helical screw 130 of a screw conveyor unit 124 which is designed in accordance with the screw conveyor unit 124 explained with reference to FIG. 1 with a helical screw 130 rotatably arranged in a cladding tube 127. In the embodiment according to FIG. 6, the helical screw 130 is designed with a first helical section 603 and with a second helical section 606, which are arranged at a distance from one another, so that a helical-free open space 609 is formed therebetween. At least one moisture sensor 315 and a sound transmission unit with a sound generator 318 and a sound sensor 321 are arranged in the region of the open space 609, with which the material transported through the cladding tube can be sampled when the helical screw 130 rotates.

Figure 7:
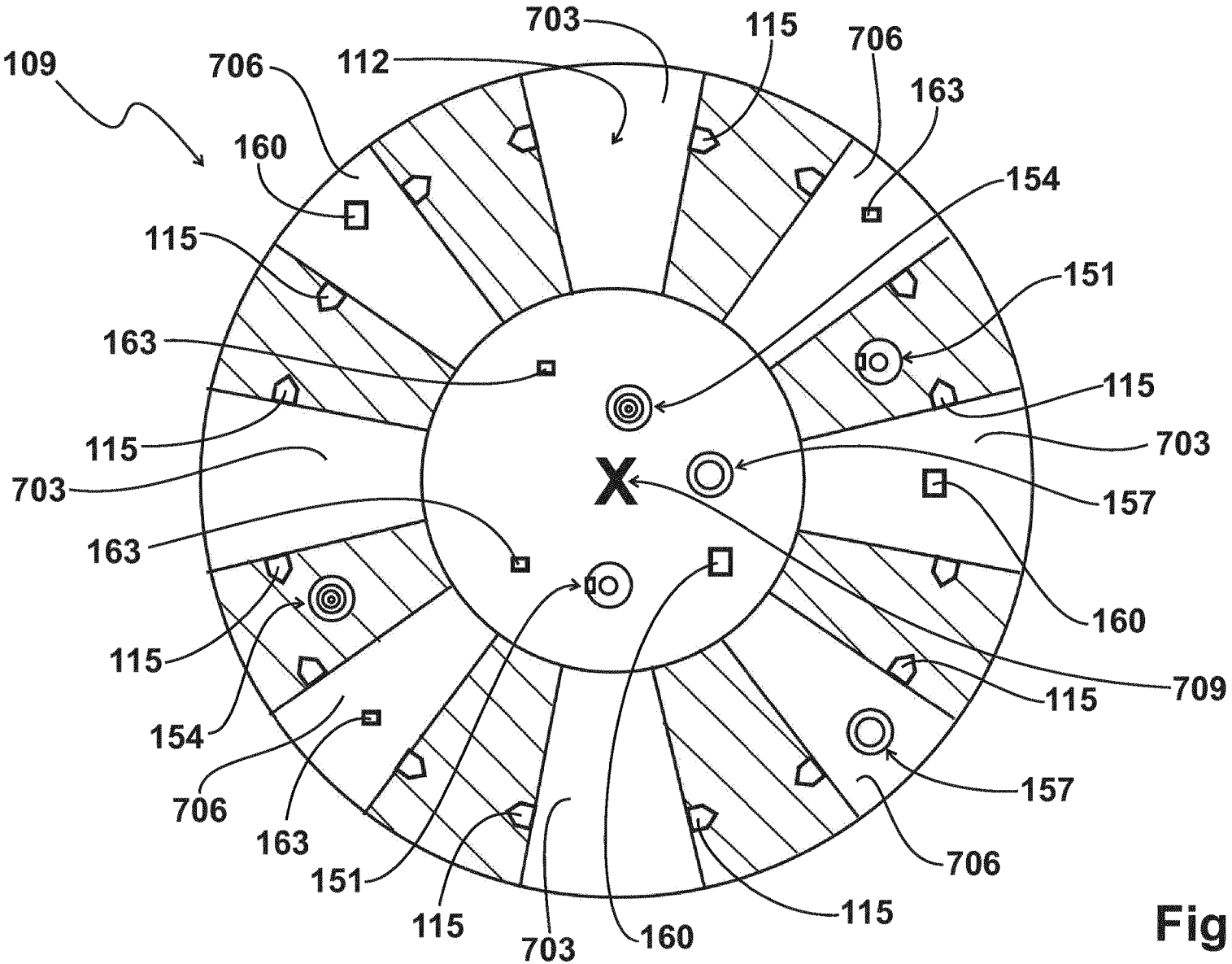
FIG. 7 shows a front view of a cutting wheel face with a number of measuring modules.

FIG. 7 shows a front view of a cutting wheel face 112 of a cutting wheel 109 of a tunnel boring machine 103, shown hatched with main arms 703 and auxiliary arms 706, as well as with intermediate openings, with a number of measuring modules, here in the form of multi-measuring modules 151, spindle measuring modules 154, ram measuring modules 157, earth pressure measuring modules 160, and temperature measuring modules 163, as well as, if required, moisture measuring modules 503, which are not shown in FIG. 7, which are arranged at different distances from a center 709 of the cutting wheel and thus on radially differently routed circumferential tracks when the cutting wheel 109 rotates. With this arrangement of the measuring modules 151, 154, 157, 160, 163, 503, as already explained above, radially different zones can be sampled separately and the consistencies of the material between the cutting wheel face 112 and the tunnel face 118 can be specifically conditioned with appropriately arranged conditioning elements.

Figure 8:
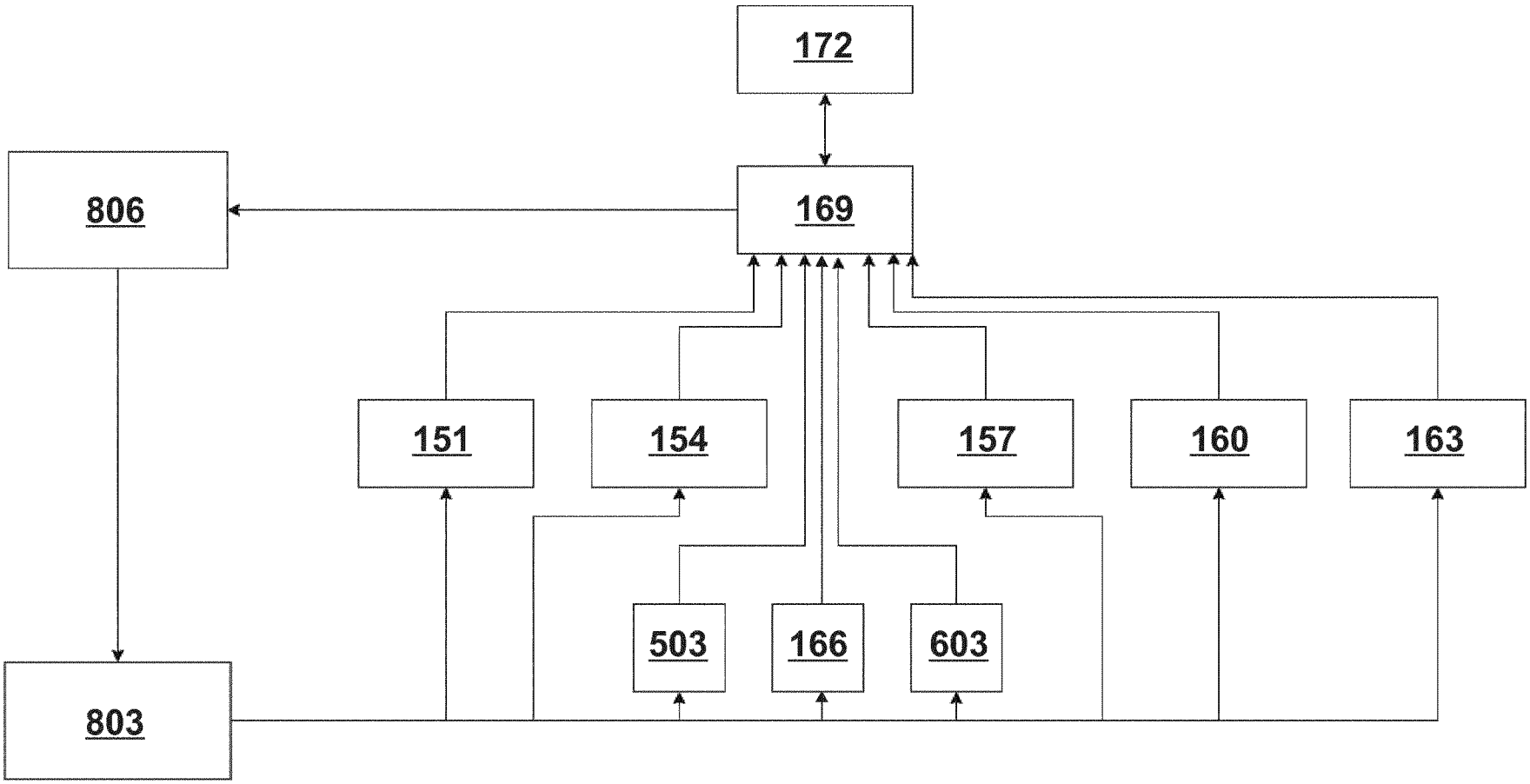
FIG. 8 shows a block diagram of an exemplary embodiment of a control circuit for adjusting consistencies.

FIG. 8 shows a block diagram of an exemplary embodiment of a control circuit for adjusting consistencies in a region with existing geology 803 between the cutting wheel face 112 and the tunnel face 118. FIG. 8 shows that the measuring modules 151, 154, 157, 160, 163, 503 record different types of measured values from the region with the existing geology 803 and supplies them to the operating data acquisition module 169. Furthermore, the images from the image acquisition module 166 are transferred to the operating data acquisition module 169 for evaluation. On the basis of the data that is supplied to the operating data acquisition module 169 and can be displayed visually via the display module 172 in the form of measured values and images, the operating data acquisition module 169 generates output data that can be supplied to a conditioning system 806, which comprises the aforementioned conditioning elements and conditioning means. The output data are configured in such a way that the consistency or consistencies in the region with the existing geology 803 between the cutting wheel face 112 and the tunnel face 118 can be adjusted with the conditioning system 806 optionally to obtain the desired consistency or consistencies.

The invention claimed is:

1. An apparatus for excavating a tunnel, comprising:

a rotatable cutting wheel (109), with which an existing geology can be excavated in an excavation direction at the front on a tunnel face (118), excavation tools (115) arranged on a cutting wheel face (112), an excavation chamber (121) arranged on the back of the cutting wheel face (112) in the excavation direction, into which excavation chamber material excavated at the tunnel face (118) can be conveyed, a discharge unit (127, 136), with which material present in the excavation chamber (121) can be removed, and at least two measuring modules (151, 154, 157, 160, 163, 503) arranged on the cutting wheel face (112) and configured to record measured values characteristic of the consistency of material excavated at the tunnel face (118) and in that measuring modules (151, 154, 157, 160, 163, 503) arranged on the cutting wheel face (112) are configured to record different types of measured values for conditioning the material between the cutting wheel face (112) and the tunnel face (118) accordingly.

2. The apparatus according to claim 1, wherein the measuring modules arranged on the cutting wheel face (112) have, in pairs, a multi-measuring module (151), a spindle measuring module (154), a ram measuring module (157), an earth pressure measuring module (160), a temperature measuring module (163), and a moisture measuring module (503), or combinations with three or more measuring modules (151, 154, 157, 160, 163, 503).

3. The apparatus according to claim 1, wherein the measuring modules (151, 154, 157, 160, 163, 503) are configured to record different types of measured values for the consistency of material in the excavation chamber (121).

4. The apparatus according to claim 1, wherein the the measuring modules are connected to an operating data acquisition module (169).

5. The apparatus according to claim 4, wherein there is an image acquisition module (166) connected to the operating data acquisition module (169), with which image acquisition module material removed from the excavation chamber (121) can be recorded in images.

6. The apparatus according to claim 4, wherein there is a control circuit comprising the operating data acquisition module (169), with which control circuit the consistencies of the material between the cutting wheel face (112) and the tunnel face (118), on the one hand, and in the excavation chamber (121), on the other hand, is adjustable via the conditioning elements, based on the types of measured values.

7. The apparatus according to claim 1, wherein at least one of the measuring modules extends through the cutting wheel.

8. The apparatus according to claim 1, wherein at least one of the measuring modules is exposed through the cutting wheel in the excavation direction.

9. The apparatus according to claim 1, wherein at least one of the measuring modules is downstream of the excavation chamber.

10. The apparatus according to claim 1, further comprising conditioning elements arranged between the cutting wheel face (112) and the tunnel face (118) for producing specific consistencies in the material between the cutting wheel face (112) and the tunnel face (118).

11. The apparatus according to claim 1, further comprising conditioning elements arranged between the cutting wheel face (112) and the tunnel face (118) for producing at least two zones of different consistencies in the material between the cutting wheel face (112) and the tunnel face (118).

12. A method for excavating a tunnel comprising:

providing an apparatus comprising:

a rotatable cutting wheel (109), with which an existing geology can be excavated in an excavation direction at the front on a tunnel face (118), excavation tools (115) arranged on a cutting wheel face (112), an excavation chamber (121) arranged on the back of the cutting wheel face (112) in the excavation direction, into which excavation chamber material excavated at the tunnel face (118) can be conveyed, a discharge unit (127, 136), with which material present in the excavation chamber (121) can be removed, and at least two measuring modules (151, 154, 157, 160, 163, 503) arranged on the cutting wheel face (112) and configured to record measured values characteristic of the consistency of material excavated at the tunnel face (118) and in that measuring modules (151, 154, 157, 160, 163, 503) arranged on the cutting wheel face (112) are configured to record different types of measured values, recording of the measured values by the at least two measuring modules (151, 154, 157, 160, 163, 503) arranged on the cutting wheel face (112), and conditioning the material present between the cutting wheel face (112) and the tunnel face (118) based on different types of measured values.

13. The method according to claim 12, wherein conditioning elements arranged in the region between the cutting wheel face (112) and the tunnel face (118) are configured to produce at least two zones of different consistencies through the appropriate addition of conditioning means, and in that these zones are each sampled with at least one measuring module (151, 154, 157, 160, 163, 503).

14. The method according to claim 12, wherein measured values are recorded by measuring modules (151, 154, 157, 160, 163, 503) arranged in the excavation chamber (121) and in that conditioning means are added for adjusting the consistencies of the material present between the cutting wheel face (112) and the tunnel face (118), on the one hand, and in the excavation chamber (121), on the other.

15. The method according to claim 12, wherein measured values are recorded when the cutting wheel (109) is stationary.

16. The method according to claim 12, wherein measured values are recorded when the cutting wheel (109) is rotating.

17. A method for excavating a tunnel, comprising:

providing an apparatus for excavating a tunnel that includes a rotatable cutting wheel for excavating material in an excavation direction at a tunnel face and at least two measuring modules arranged on the cutting wheel face for recording at least two different measured values characteristic of the consistency of the material excavated at the tunnel face;

recording of the different measured values during excavation; and conditioning the material present between the cutting wheel face and the tunnel face based on the different types of measured values recorded.

18. The method according to claim 17, wherein at least one of the measuring modules extends through the cutting wheel.

19. The method according to claim 17, wherein at least one of the measuring modules is exposed through the cutting wheel in the excavation direction.

20. The method according to claim 17, wherein at least one of the measuring modules is downstream of the excavation chamber.

* * * * *